United States Patent [19]

Mascia

[11] 4,187,963

[45] Feb. 12, 1980

[54] ADAPTER RING FOR DISPENSING OVERCAP

[75] Inventor: Carmen T. Mascia, Clarendon Hills, Ill.

[73] Assignee: The Continental Group, Inc., New York, N.Y.

[21] Appl. No.: 944,954

[22] Filed: Sep. 22, 1978

[51] Int. Cl.[2] ..... B65D 83/14

[52] U.S. Cl. ..... 222/402.13

[58] Field of Search ..... 222/182, 402.1, 402.12, 222/402.13, 402.15, 502, 514, 518, 545, 570; 220/85 P, 256; 251/291; 137/320

[56] References Cited

U.S. PATENT DOCUMENTS

| | | | |
|---|---|---|---|
| 3,199,741 | 8/1965 | Lehmann | 222/402.13 |
| 3,313,459 | 4/1967 | Mizoguchi | 222/514 X |
| 3,462,045 | 8/1969 | Markowitz | 222/182 |
| 3,655,100 | 4/1972 | Markowitz | 222/182 |
| 3,690,519 | 9/1972 | Wassilieff | 222/182 X |
| 3,844,448 | 10/1974 | Sette | 222/182 X |

*Primary Examiner*—Charles A. Marmor

*Attorney, Agent, or Firm*—Charles E. Brown

[57] ABSTRACT

An adapter ring for adapting a dispensing overcap for a predetermined diameter aerosol can to an end unit of an aerosol can of a larger diameter. The adapter ring includes an axially movable valve stem adapter which provides a fluid connection between the dispensing overcap and the valve stem of the aerosol can.

10 Claims, 4 Drawing Figures

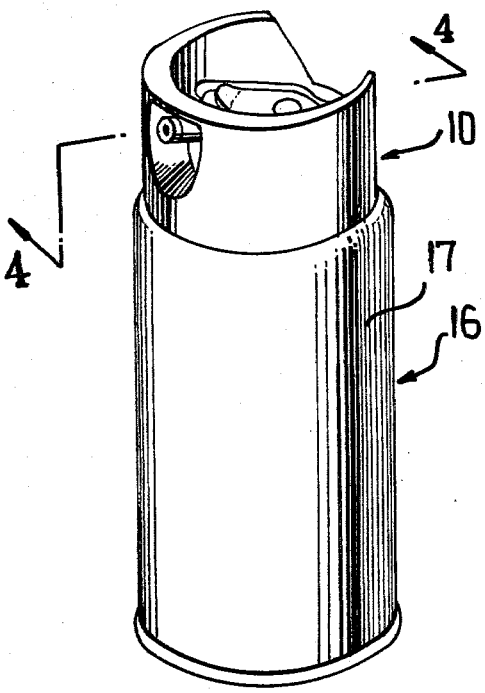
FIG. 1
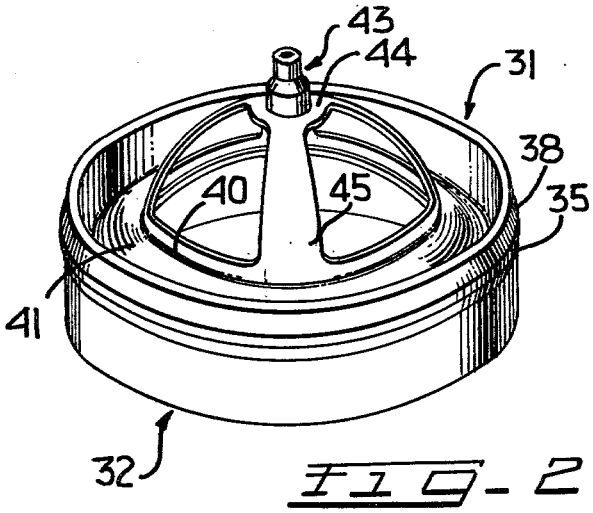
FIG. 2
FIG. 3
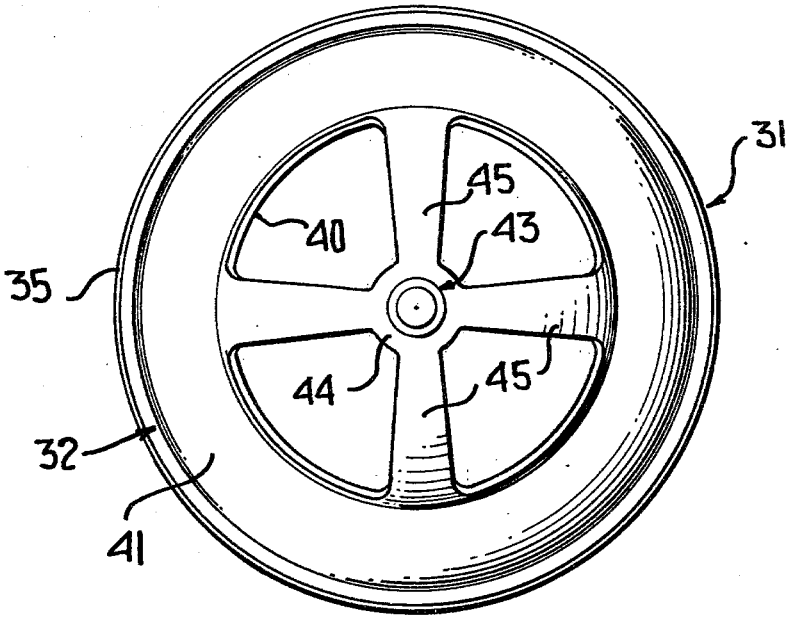

ADAPTER RING FOR DISPENSING OVERCAP

This invention relates to new and useful improvements in aerosol containers, and more particularly to an adapter ring for use in aerosol containers having dispensing overcaps.

This invention most particularly relates to the adaptation of a dispensing overcap of the type disclosed in U.S. Pat. No. 3,373,908 to aerosol cans other than those for which it was particularly adapted.

Most particularly, equipment has been made for forming dispensing overcaps of the type disclosed in U.S. Pat. No. 3,373,908 for a specific size container, which container is of a size different from containers which are mass produced by others. As a result, the production cost of such dispensing overcaps has been relatively high. On the other hand, the overcap is a very satisfactory device.

In accordance with this invention, it is proposed to provide an adapter ring which will seat on a container end unit of the dispensing type suitable for aerosol cans and which will adapt the dispensing overcap to that end unit.

Most specifically, the adapter ring includes a support portion for fixedly mounting it on a dispensing end unit of a conventional larger diameter can than that for which the dispensing overcap is designed, with the adapter ring including a valve stem adapter which is engageable over the valve stem of the end unit and forms a continuation thereof for engagement with the overcap. The overcap is interlockingly engageable with the adapter ring so as to retain it in combination with the adapter ring.

With the above and other objects in view that will hereinafter appear, the nature of the invention will be more clearly understood by reference to the following detailed description, the appended claims, and the several views illustrated in the accompanying drawings.

IN THE DRAWINGS

FIG. 1 is a top perspective view of the known dispensing overcap mounted on a can of a larger diameter than the can for which it was originally intended.

FIG. 2 is a top perspective view of an adapter ring formed in accordance with the invention.

FIG. 3 is an enlarged plan view of the adapter ring.

Figure 4:
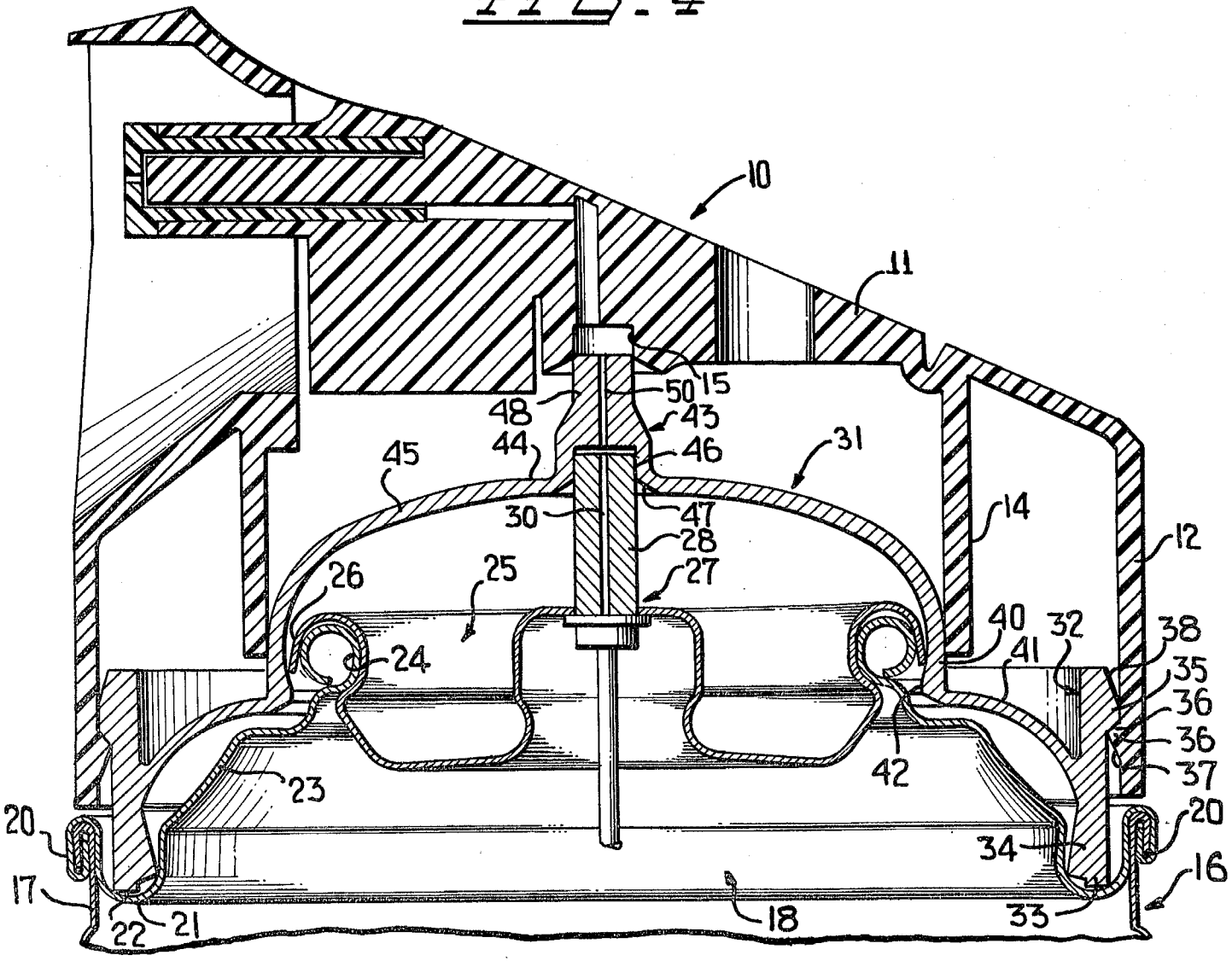
FIG. 4 is an enlarged fragmentary vertical sectional view taken along the line 4—4 of FIG. 1.

Referring now to the drawings in detail, it will be seen that there is illustrated in FIG. 4 a dispensing overcap which is generally identified by the numeral 10 and which is constructed in accordance with U.S. Pat. No. 3,373,908. The overcap 10, as originally constructed, is intended to fit on a dispensing end unit of a can of a prescribed diameter. As far as this invention is concerned, the dispensing overcap 10 includes a body 11 having a depending skirt 12. The skirt 12 is provided with an internal rib or projection 13 for locking the same on a dispensing end unit against removal. The overcap 10 also includes an inner sleeve 14. Finally, the dispensing overcap 10 includes a bore or socket 15 of a size particularly adapted to receive therein an end portion of a valve stem of a dispensing end unit.

The dispensing overcap 10 is illustrated in FIGS. 1 and 4 as being mounted on an aerosol can 16 having a body 17 which, at least at the upper end thereof, is of a diameter different than the diameter of the can for which the overcap 10 was intended. While the illustrated can 16 is shown as having an upper end portion thereof necked in to a smaller diameter, it is to be understood that the can body 17 could be of the same diameter throughout providing, of course, it is of the proper diameter.

As is best shown in FIG. 4, the upper end of the body 17 is closed by means of a conventional dispensing end unit, generally identified by the numeral 18, which is secured to the body 17 by a conventional double seam 20. The end unit 18 is particularly adapted for use in conventional aerosol cans and is provided with a peripherally inwardly directed bead 21 defining an upwardly opening channel 22 immediately adjacent the double seam 20. The main portion of the end unit 18 which generally constitutes the end panel is in the form of a conically shaped portion 23 which terminates at its upper end in a conventional curl 24.

The opening defined by the curl 24 is closed in a conventional manner by the securement of a valve cup 25 to the curl by way of a crimped flange 26.

The valve cup 25 carries a valve assembly, generally identified by the numeral 27, which includes a conventional valve stem 28 having a product dispensing bore 30 extending axially therethrough.

It is to be understood that the dispensing overcap 10 is so proportioned relative to the can 16 that if the can 16 were of the intended size the skirt 12 would fit over the double seam 20 with the rib 13 being interlocked therebeneath to lock the overcap against removal. However, because the end unit 18 is of a larger diameter than the end unit for which the overcap is intended, the skirt 12 is generally aligned with the double seam 20.

In order that the overcap 10 may be utilized with the larger diameter end unit, in accordance with this invention there is provided an adapter ring, generally identified by the numeral 31. The adapter ring 31 includes a lower support ring 32 which is annular and which includes a lower portion 33 adapted to seat within the channel 22. The inner surface of the lower portion 33 includes a wedge shaped radially inwardly directed portion 34 which wedges against the inner wall of the channel 22 and serves to lock the adapter ring 31 to the end unit 18.

The outer surface of the upper portion of the support ring 32 is provided with a radially outwardly directed rib 35 having a downwardly directed face 36 beneath which the rib 13 may interlock. It is to be noted that the rib 13 has a lower cam surface 37 which is engageable with an upper cam surface 38 of the projection 35 so as to facilitate the radially outward expanding of the lower portion of the skirt 12 as is required to snap the skirt 12 over the support ring 32 to the retained position illustrated in FIG. 4.

If desired, there may be a further interlock between the adapter ring 31 and the end unit 18. When desired, the adapter ring 31 will also include an inner ring portion 40 which is integrally connected to the support ring 32 by an intermediate portion 31. The lower part of the inner surface of the inner ring 40 is in the form of a radially inwardly directed projection 42 which is engageable beneath the crimped flange 26 of the valve cup 25.

The adapter ring 31 is provided with an upper central portion in the form of a valve stem adapter 43. The valve stem adapter 43 includes a lower ring portion 44 which is connected to the inner ring 40 by a plurality of circumferentially spaced arms 45. As is best shown in FIG. 3, the arms 45 taper in width from their lower ends to the ring 44.

The valve stem adapter 43 has a lower socket 46 defined by a bore which includes a conical lower portion 47 so that the upper end of the valve stem 43 may be readily telescoped into the socket 46 and seated therein in sealed engagement.

The upper end of the valve stem adapter 43 is in the form of a valve stem extension 48 which is of a size to be received in the socket or bore 15 in the overcap 10. The valve stem adapter 43 has a bore 50 therethrough which is aligned with the bore 30 in the valve stem 38 when the valve stem 31 is assembled on the end unit 18.

It is also to be noted here that the outer diameter of the inner ring 40 corresponds to the inner diameter of the sleeve 14 so that the lower part of the sleeve 14 is telescoped over the inner ring 40 in axially sliding relation.

When it is desired to utilize the aerosol container equipped with the adapter ring 31 and the dispensing overcap 10, there is a downwardly directed pressure on the overcap 10 in the usual manner with the result that the arms 45 flex and permit the valve stem adapter 43 to move downwardly, thereby causing downward movement of the valve stem 48 to open the valve with which it is associated in a conventional manner and effect delivery of the stored product under pressure to the overcap 10 through the valve stem adapter 43 in the normal manner. The skirt 12 and the sleeve 14 are also free to move downwardly with respect to the end unit 18 in the customary manner.

Although only a preferred embodiment of the adapter ring has been specifically illustrated and described herein, it is to be understood that minor variations may be made therein without departing from the spirit and scope of the invention as defined by the appended claims.

I claim:

1. An adapter ring for adapting a dispensing overcap to a dispensing end unit of an aerosol and the like container having a valve stem, said adapter ring comprising an annular support ring having first means on a lower portion for seating engagement with a dispensing end unit and second means on an upper portion for interlocking engagement with a dispensing overcap, an axially extending valve stem adapter centered relative to said support ring and axially spaced relative thereto for providing a fluid connection between a valve stem and a dispensing cap, and connecting means between said support ring and said valve stem adapter mounting said valve stem adapter on said support ring for limited axial movement relative to said support ring.

2. The adapter ring of claim 1 wherein said first means includes a base for seating on an end unit and wedge means for tightly circumferentially engaging an annular portion of an end unit.

3. The adapter ring of claim 1 wherein said second means includes a radially outwardly directed rib having an axially facing shoulder facing generally toward said support ring lower portion.

4. The adapter ring of claim 1 wherein said connecting means include a plurality of circumferentially spaced arms, said arms being resiliently deflectable.

5. The adapter ring of claim 4 wherein said arms are arched shaped.

6. The adapter ring of claim 1 wherein said valve stem adapter has a lower bore for receiving an end unit valve stem in sealed relation, an upper stem extension, and a bore through said stem extension opening into said lower bore.

7. The adapter ring of claim 1 wherein there is an inner support ring having an inner surface portion forming means for interlocking engagement with a valve cup carried by said dispensing end unit.

8. The adapter ring of claim 1 wherein there is an inner support ring having an inner surface portion forming means for interlocking engagement with a valve cup carried by said dispensing end unit, and an outer surface portion forming means for frictional engagement with an inner sleeve of a dispensing overcap.

9. The adapter ring of claim 7 in combination with a dispensing overcap, said overcap including an outer skirt engaged with said first means on said support ring to prevent axial separation, said overcap including an inner sleeve, said sleeve being slidably engaged with said inner support ring and said skirt being slidably engaged with said support ring for relative telescoping movement of said overcap and said adapter ring.

10. An adapter ring for adapting a dispensing overcap to a dispensing end unit of an aerosol and the like container, said adapter ring comprising an annular support ring having first means on a lower portion for seating engagement with a dispensing end unit and second means on an upper portion for interlocking engagement with a dispensing overcap, a valve stem adapter centered relative to said support ring and axially spaced relative thereto, and connecting means between said support ring and said valve stem adapter mounting said valve stem adapter on said support ring for limited axial movement relative to said support ring, in combination with a container having a dispensing end unit having a dispensing valve, said adapter ring being seated on said end unit, and a dispensing overcap interlocked with said adapter ring and being axially movable relative to said container for actuating said dispensing valve.

* * * * *